US011378283B2

(12) United States Patent
Hasegawa et al.

(10) Patent No.: US 11,378,283 B2
(45) Date of Patent: Jul. 5, 2022

(54) HOT WATER SUPPLY DEVICE

(71) Applicant: NORITZ CORPORATION, Hyogo (JP)

(72) Inventors: Takahide Hasegawa, Kakogawa (JP); Atsushi Ushio, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 227 days.

(21) Appl. No.: 16/815,010

(22) Filed: Mar. 11, 2020

(65) Prior Publication Data

US 2020/0309387 A1 Oct. 1, 2020

(30) Foreign Application Priority Data

Mar. 25, 2019 (JP) ..... JP2019-055992

(51) Int. Cl.

| | |
|---|---|
| ***F24D 17/00*** | (2022.01) |
| ***F24D 19/10*** | (2006.01) |
| ***F24D 19/00*** | (2006.01) |
| ***F24H 1/10*** | (2022.01) |
| *F24H 9/00* | (2022.01) |

(52) U.S. Cl.

CPC ..... *F24D 19/0092* (2013.01); *F24D 17/0078* (2013.01); *F24D 19/1051* (2013.01); *F24H 1/101* (2013.01); *F24H 9/0042* (2013.01)

(58) Field of Classification Search

None

See application file for complete search history.

(56) References Cited

U.S. PATENT DOCUMENTS 5,829,467 A * 11/1998 Spicher ..... F24D 17/0078 137/14
2013/0247997 A1* 9/2013 Ng ..... F24S 90/00 137/13
2015/0377497 A1* 12/2015 Haws ..... F24D 17/0089 137/337

(Continued)

FOREIGN PATENT DOCUMENTS

CA 2790092 A1 * 8/2011 ..... F24D 17/0078
CA 2948505 A1 * 5/2018 ..... F24D 17/0078
CA 3002454 A1 * 8/2019 ..... F24H 9/2021

(Continued)

OTHER PUBLICATIONS

English Translation of CA-3002454-A1 (Year: 2019).*

(Continued)

*Primary Examiner* — Michael G Hoang
*Assistant Examiner* — Kurt J Wolford
(74) *Attorney, Agent, or Firm* — JCIPRNET

(57) ABSTRACT

A scale adhesion prevention operation of a circulation pump operated in an instant hot water operation is efficiently and appropriately performed. An instant hot water circulation path is formed to bypass a hot water tap outside a hot water supply device and to pass through a heat exchanger inside the hot water supply device by operating a circulation pump when the hot water tap is closed. A controller performs a protection operation which operates the circulation pump when a first condition in which stop of the circulation pump is continued for a first time is satisfied and a second condition related to stop of a hot water supply operation is further satisfied.

8 Claims, 9 Drawing Sheets

(56) References Cited

U.S. PATENT DOCUMENTS

| | | | | |
|---|---|---|---|---|
| 2018/0238586 | A1* | 8/2018 | Sugatani | F24H 9/0042 |
| 2020/0277760 | A1* | 9/2020 | Scafe | F24D 19/1051 |

FOREIGN PATENT DOCUMENTS

| | | | | |
|---|---|---|---|---|
| DE | 102010049341 | A1 * | 4/2012 | F24D 17/0073 |
| EP | 2922129 | A1 * | 9/2015 | H01M 8/04373 |
| FR | 2572790 | A1 * | 5/1986 | F16L 53/32 |
| JP | 2018136067 | | 8/2018 | |
| JP | 2019058224 | A * | 4/2019 | |
| WO | WO-2011064880 | A1 * | 6/2011 | B08B 9/027 |
| WO | WO-2014125678 | A1 * | 8/2014 | F24D 19/1012 |

OTHER PUBLICATIONS

English Translation of JP-2019058224-A (Year: 2019).*
English Translation of CA-2948505-A1 (Year: 2018).*
English Translation of EP-2922129-A1 (Year: 2015).*
English Translation of WO-2014125678-A1 (Year: 2014).*
English Translation of DE-102010049341-A1 (Year: 2012).*
English Translation of CA-2790092-A1 (Year: 2011).*
English Translation of WO-2011064880-A1 (Year: 2011).*
English Translation of FR-2572790-A1 (Year: 1986).*
American Burn Association, "Scald Injury Prevention Educator's Guide" (Year: 2017).*

* cited by examiner

| CONDITION | ITEM |
|---|---|
| XA | T1 OR MORE HAS ELAPSED SINCE PREVIOUS CIRCULATION PUMP STOP |
| XB | HOT WATER SUPPLY OPERATION OFF (ALSO, OUT OF RESERVATION PERIOD OF INSTANT HOT WATER OPERATION) |
| /XB | HOT WATER SUPPLY OPERATION ON (OR, WITHIN RESERVATION PERIOD OF INSTANT HOT WATER OPERATION) |
| YA | T2 OR MORE HAS ELAPSED SINCE CIRCULATION PUMP PREVENTION OPERATION IS TURNED ON (T2<T1) |
| YB | IDLING RISK DETECTION (Q<Qx CONTINUES FOR Tx) |
| YC | T3 OR MORE HAS ELAPSED SINCE CIRCULATION PUMP PREVENTION OPERATION IS TURNED ON (T3<T2) |

FIG. 4

| CONDITION | ITEM |
|---|---|
| XA | T1 OR MORE HAS ELAPSED SINCE PREVIOUS CIRCULATION PUMP STOP |
| XB | HOT WATER SUPPLY OPERATION OFF (ALSO, OUT OF RESERVATION PERIOD OF INSTANT HOT WATER OPERATION) |
| /XB | HOT WATER SUPPLY OPERATION ON (OR, WITHIN RESERVATION PERIOD OF INSTANT HOT WATER OPERATION) |
| XC | TIME POINT WHEN T4 HAS ELAPSED SINCE POWER SUPPLY IS TURNED ON |
| YA | T2 OR MORE HAS ELAPSED SINCE CIRCULATION PUMP PREVENTION OPERATION IS TURNED ON (T2<T1) |
| YB | IDLING RISK DETECTION (Q<Qx CONTINUES FOR Tx) |
| YC | T3 OR MORE HAS ELAPSED SINCE CIRCULATION PUMP PREVENTION OPERATION IS TURNED ON (T3<T2) |

FIG. 8

HOT WATER SUPPLY DEVICE

CROSS-REFERENCE TO RELATED APPLICATION

This application claims the priority benefit of Japan application serial no. 2019-055992, filed on Mar. 25, 2019. The entirety of the above-mentioned patent application is hereby incorporated by reference herein and made a part of this specification.

BACKGROUND

Technical Field

The present disclosure relates to a hot water supply device, and more particularly, to a hot water supply device having an instant hot water function.

Description of Related Art

As one type of a hot water supply device, there is a device having a so-called instant hot water function in which hot water of an appropriate temperature is output immediately after hot water supply is started even after hot water supply has been turned off for a long time. Normally, in order to realize the instant hot water function, it is necessary to provide a mode for forming a circulation path via a heat source even while hot water supply is stopped (hereinafter, an instant "hot water operation mode"). The instant hot water function can also contribute to water saving by reducing waste water.

Japanese Patent Laid-Open No. 2018-136067 (Patent Literature 1) describes a configuration in which an instant hot water circulating unit including a circulation pump is externally mounted on a water heater to realize an instant hot water function. The hot water circulation unit of Patent Literature 1 further includes a cleaning tank for storing a cleaning agent and automatically performs a cleaning operation using the cleaning agent periodically, specifically, after a lapse of a certain time or every time hot water is supplied at a certain flow rate, by operating the circulation pump. Accordingly, it is possible to prevent scale from adhering to the inside of a piping, particularly in a heat exchanger.

Patent Literatures

[Patent Literature 1] Japanese Patent Laid-Open No. 2018-136067

SUMMARY

In a hot water supply device with an instant hot water function, when a circulation pump is continuously stopped for a long period of time in the summer, or the like, for example, in areas in which hard water is used as clean water, there is concern of a rotating shaft becoming stuck due to scale adhering around a pump bearing. On the other hand, in an environment in which a circulation pump is operated at a certain frequency, such as in the winter, similar fixation is unlikely to occur. Therefore, as in the cleaning operation of Patent Literature 1, even when the cleaning operation is performed after a lapse of a certain time or every time hot water is supplied at a certain flow rate, it is difficult to efficiently prevent the adhesion of scale.

Further, in order to prevent scale adhesion in a circulation pump, it is not necessary to use a cleaning agent, and the amount of time taken by cleaning operations such as that in Patent Literature 1 is not necessary. Therefore, unlike the cleaning operation of Patent Literature 1, a scale adhesion preventing operation of a circulation pump can be easily switched to a hot water supply operation.

The disclosure has been made in order to solve such problems, and it is desirable to efficiently and appropriately perform a scale adhesion preventing operation of a circulation pump which is operated in an instant hot water operation.

According to an aspect of the disclosure, there is provided a hot water supply device which supplies hot water to a hot water tap, including a heating mechanism, an internal path, and a controller. The internal path forms an instant hot water circulation path through which a fluid passes through the heating mechanism, together with an external path which bypasses the hot water tap outside the hot water supply device when the hot water tap is closed and a circulation pump is operated. The controller instructs operation and stop of the heating mechanism and the circulation pump, wherein the controller performs a protection operation of operating the circulation pump for a second time when a first condition that the stop of the circulation pump have continued for a first time is satisfied and a second condition related to stop of a hot water supply operation is further satisfied.

According to the disclosure, it is possible to efficiently and appropriately perform a scale adhesion preventing operation of a circulation pump which is operated in an instant hot water supply operation.

BRIEF DESCRIPTION OF THE DRAWINGS

FIG. 4 is a chart showing a list of content of each condition shown in FIG. 3.

FIG. 8 is a chart showing a list of content of conditions shown in FIG. 7.

DESCRIPTION OF THE EMBODIMENTS

Figure 1:
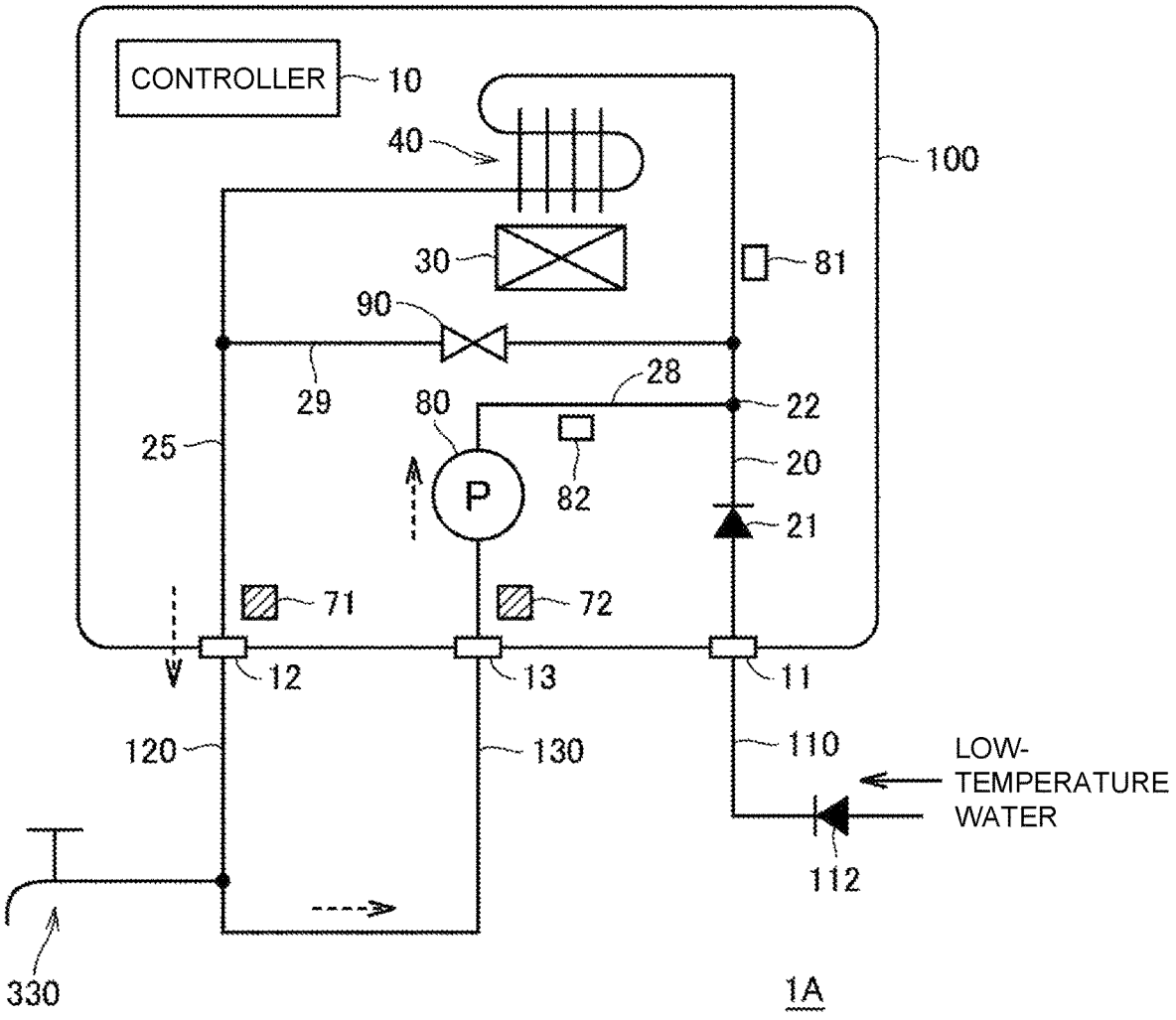
FIG. 1 is a block diagram showing a configuration of a hot water supply system including a hot water supply device according to an embodiment.

Hereinafter, embodiments of the present disclosure will be described in detail with reference to the drawings. The same or corresponding parts in the drawings are given the same reference numerals below, and description thereof will not be repeated in principle.

Embodiment 1

FIG. 1 is a block diagram showing a configuration of a hot water supply system having an instant hot water function.

Referring to FIG. 1, a hot water supply system 1A includes a hot water supply device 100 according to the embodiment, a low-temperature water pipe 110, a high-temperature water pipe 120, and a circulation pipe 130. The hot water supply device 100 has a water inlet port 11, a hot water outlet port 12, and a circulation port 13.

Low-temperature water is supplied to the low-temperature water pipe 110 via a check valve 112. The low-temperature water is typically supplied from a water pipe (not shown). The low-temperature water pipe 110 is connected to the water inlet port 11. The high-temperature water pipe 120 connects the hot water outlet port 12 and a hot water tap 330. The circulation pipe 130 connects the high-temperature water pipe 120 and the circulation port 13.

The hot water supply device 100 includes a controller 10, a water inlet path 20, a hot water outlet path 25, a circulation path 28, a bypass path 29, a heat source unit 30, a heat exchanger 40, a circulation pump 80, and a flow rate control valve 90.

The water inlet path 20 is formed between the water inlet port 11 and an input side (an upstream side) of the heat exchanger 40 via a check valve 21.

The heat source unit 30 is typically configured by a burner which generates an amount of heat by burning gas, oil, or the like. The heat exchanger 40 raises a temperature of the low-temperature water (a fluid) introduced by the water inlet path 20 using the amount of heat generated by the heat source unit 30. Therefore, the heat source unit 30 and the heat exchanger 40 can constitute an example of a "heating mechanism." Alternatively, it is also possible to configure the "heating mechanism" using a heat pump or waste heat generated during power generation.

The hot water outlet path 25 is formed between an output side (a downstream side) of the heat exchanger 40 and the hot water outlet port 12. The bypass path 29 guides some of the low-temperature water to the hot water outlet path 25 by bypassing the heat exchanger 40. A flow ratio between the bypass path 29 and the heat exchanger 40 can be controlled by an opening command of the flow rate control valve 90 from the controller 10. Thus, in the hot water outlet path 25, some of the low-temperature water is mixed downstream of the heat exchanger 40 without being heated, and thus high-temperature water is supplied from the hot water outlet port 12.

In addition, the hot water supply device 100 may be configured without the arrangement of the bypass path 29 and the flow rate control valve 90, so that the entire amount of the introduced low-temperature water flows through the heat exchanger 40. However, in the bypass configuration shown in FIG. 1, since an output temperature from the heat exchanger 40 (the heating mechanism) can be increased, it is advantageous for curbing drainage generated by exhaust of the heat source unit 30 being cooled on a surface of the heat exchanger 40.

The circulation path 28 is formed between the circulation port 13 and the water inlet path 20 (a connection point 22). The circulation pump 80 is connected to the circulation path 28. Alternatively, the circulation pump 80 may be disposed in the circulation pipe 130 as an external element of the hot water supply device 100. Regardless of whether the circulation pump 80 is disposed inside or outside the hot water supply device 100, the operation and stop of the circulation pump 80 are controlled by the controller 10.

A flow rate detector 81 which outputs a flow rate value of the low-temperature water is disposed in the water inlet path 20, and a flow rate detector 82 is disposed in the circulation path 28. The flow rate detector 82 may be configured by a sensor which outputs an actual flow rate value similarly to the flow detector 81 or may be configured by a water flow sensor (a switch) which detects the presence or absence of a flow. The values detected by the flow rate detectors 81 and 82 are input to the controller 10.

Further, a temperature detector 71 is disposed in the hot water outlet path 25, and a temperature detector 72 is disposed in the circulation path 28. A fluid temperature detected by the temperature detectors 71 and 72 is input to the controller 10.

Figure 2:
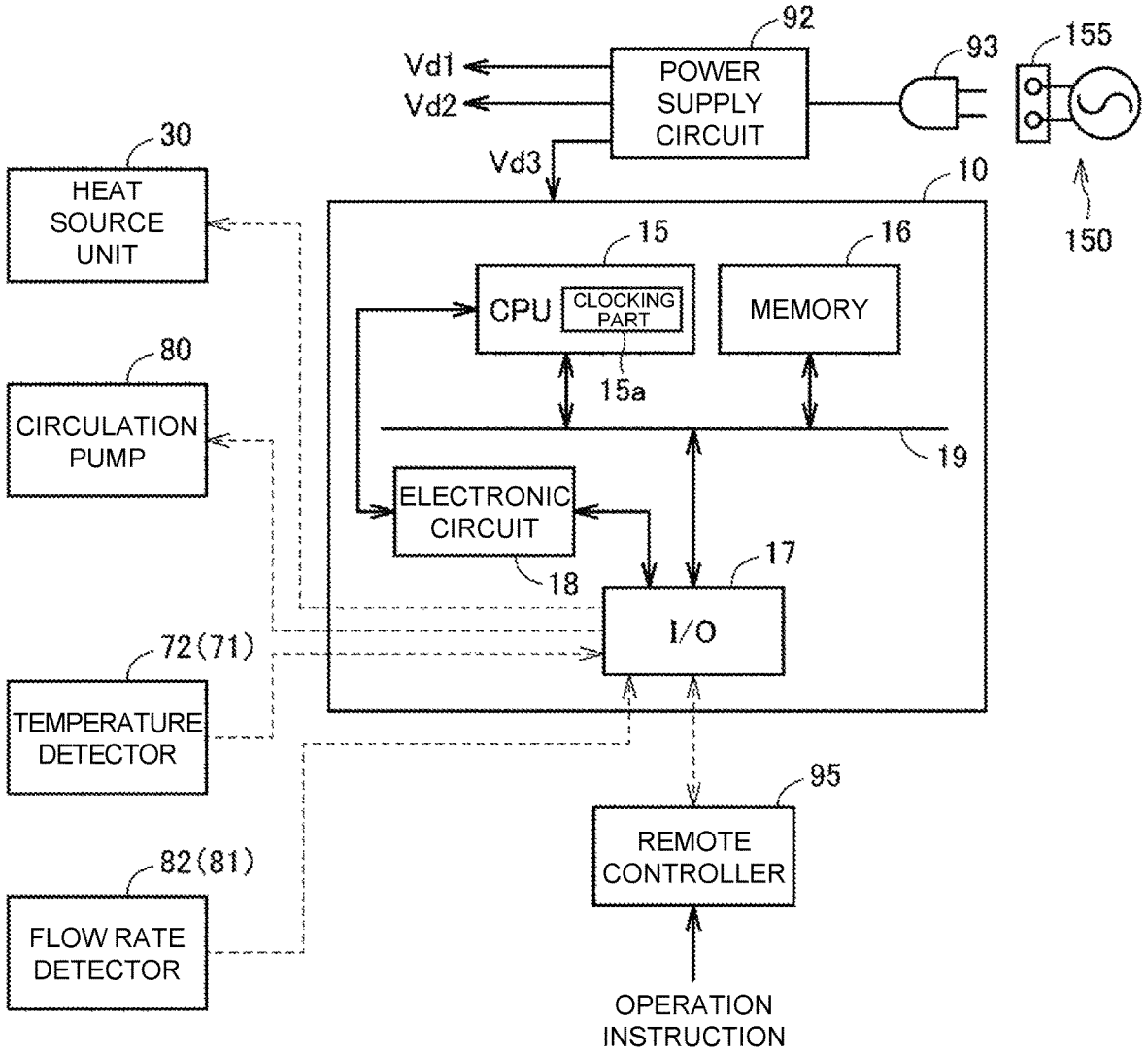
FIG. 2 is a block diagram showing a configuration example of a controller and related hardware shown in FIG. 1.

FIG. 2 is a block diagram showing an example of a hardware configuration of the controller 10.

Referring to FIG. 2, the controller 10 is typically configured by a microcomputer. The controller 10 includes a central processing unit (CPU) 15, a memory 16, an input/output (I/O) circuit 17, and an electronic circuit 18. The CPU 15, the memory 16, and the I/O circuit 17 can mutually exchange signals via a bus 19. The electronic circuit 18 is configured to perform predetermined arithmetic processing by dedicated hardware. The electronic circuit 18 can exchange signals between the CPU 15 and the I/O circuit 17.

The CPU 15 receives output signals (detected values) from sensors including the temperature detectors 71 and 72 and the flow rate detectors 81 and 82 through the I/O circuit 17. Further, the CPU 15 receives a signal indicating an operation instruction input to a remote controller 95 through the I/O circuit 17. The operation instruction includes, for example, an on/off operation of an operation switch, a hot water setting temperature, and various time reservation settings (also referred to as "timer reservation settings") in the hot water supply device 100. The CPU 15 controls an operation of each component including the heat source unit 30 and the circulation pump 80 so that the hot water supply device 100 is operated according to the operation instruction.

Further, the CPU 15 includes a clocking part 15*a* which measures an elapsed time. Furthermore, the CPU 15 can output information, which can be visually or audibly recognized, to a user using a display screen or a speaker (not shown) provided in the remote controller 95.

Electric power of the hot water supply device 100 is supplied from a system power supply 150. The hot water supply device 100 further includes a power supply circuit 92. For example, when a plug 93 is connected to an electrical outlet 155 connected to the system power supply 150, electric power from the system power supply 150 is supplied to the power supply circuit 92. Hereinafter, a state in which electric power is supplied from the system power supply 150 to the hot water supply device 100 is also referred to as a "power-on state," a state in which electric power is not supplied from the system power supply 150 to the hot water supply device 100 is also referred to as a "power-off state," and transition from the power-off state to the power-on state due to a connection of the plug 93 to the electrical outlet is also referred to as "power supply."

In the power-on state, the power supply circuit 92 converts electric power from the system power supply 150 into power supply voltages Vd1 to Vd3 supplied to various devices inside the hot water supply device 100. On the other hand, in the power-off state, since the supply of the power supply voltages Vd1 to Vd3 is stopped, the operation of the controller 10 is also stopped. In the power-off state, time measurement by the clocking part 15*a* is also stopped.

When the power is supplied, the controller 10 makes the hot water supply device 100 operable by performing a predetermined initial process. Normally, due to the initial process, a time measured by the clocking part 15*a* is cleared to zero.

Referring to FIG. 1 again, the operation of the hot water supply device 100 will be described.

At the time of opening a tap, that is, when the hot water tap 330 is opened, the low-temperature water is introduced into the water inlet path 20 by a supply pressure of the low-temperature water. When the flow rate detector 81 detects a flow rate which exceeds a minimum operating flow rate (MOQ) while the operation switch of the hot water supply device 100 is switched on, the controller 10 operates the heat source unit 30. As a result, the high-temperature water heated by the heat source unit 30 and the heat exchanger 40 is output to the high-temperature water pipe 120 and the hot water tap 330 via the hot water outlet path 25 and the hot water outlet port 12, and thus a hot water supply operation is performed. During the hot water supply operation, the circulation pump 80 is stopped, and an amount of heating by the heat source unit 30 (the heating mechanism) is controlled so that a fluid temperature (a hot water outlet temperature) detected by the temperature detector 71 is controlled to the hot water setting temperature input to the remote controller 95. On the other hand, when the flow rate becomes lower than the MOQ due to closing of the tap, or during an OFF period of the operation switch, the hot water supply operation is stopped by the controller 10 stopping the heat source unit 30.

While the hot water supply operation is stopped, since the temperature of the fluid staying in the hot water outlet path 25 and the high-temperature water pipe 120 decreases, there is a concern that, after the next hot water supply operation is started, it will take a long time until the high-temperature water having an appropriate temperature is output from hot water tap 330. Therefore, an instant hot water function in which the high-temperature water having an appropriate temperature is supplied immediately after the hot water supply operation is started is provided in the hot water supply device 100. The instant hot water function is realized by operating the circulation pump 80 at the time of closing the tap, that is, when the hot water tap 330 is closed, and thus forming an instant hot water circulation path including the heat source unit 30 and the heat exchanger 40.

For example, during a reservation period of an instant hot water operation mode specified by a user setting a timer reservation setting, when a temperature detected by the temperature detector 71 (the hot water outlet temperature) drops below a start determination temperature Tph1 while the hot water supply operation is stopped, an instant hot water operation is started.

In the instant hot water operation, a fluid path (an internal path) including the circulation port 13, the circulation path 28, the water inlet path 20 (on the downstream side from the connection point 22), the heat exchanger 40 (the heating mechanism), the hot water outlet path 25, and the hot water outlet port 12 is formed inside the hot water supply device 100 by operating the circulation pump 80 and the heat source unit 30 (the heating mechanism). Further, since a fluid path (an external path) which bypasses the hot water tap 330 and includes the hot water outlet port 12, the high-temperature water pipe 120, the circulation pipe 130, and the circulation port 13 can be formed outside the hot water supply device 100, the instant hot water circulation path can be formed in combination with the internal path. As a result, in the hot water supply system 1A, even when the tap is closed, the hot water supply operation of the high-temperature water having an appropriate temperature can be started immediately after the tap is opened by allowing the high-temperature water having the appropriate temperature to flow through the instant hot water circulation path.

When the hot water outlet temperature rises above a termination determination temperature Tph2 (Tph2>Tph1) with the instant hot water operation, the instant hot water operation is ended by stopping the heat source unit 30 and the circulation pump 80. That is, during the reservation period of the instant hot water operation mode, the instant hot water operation is automatically started and ended. A user can directly input and set the reservation period by operating the remote controller 95, for example. Alternatively, the reservation period of the instant hot water operation mode may be automatically set by learning a past use history of the user.

The circulation pump 80 is stopped except during the performing of the instant hot water operation. Thus, there is a possibility that the circulation pump 80 may be stopped continuously for a long period of time because an instant hot water reservation period is not set in the summer or the like or when the water temperature is high. According to water quality, when such long-term stoppage occurs, there is a concern that an inorganic salt compound (so-called scale) such as calcium in water may adhere around a bearing of the circulation pump 80. When the adhesion of scale becomes remarkable, there is a concern that the circulation pump 80 may become unusable due to fixation of a rotating shaft.

Therefore, in the hot water supply device according to the embodiment, an operation for protecting the circulation pump 80 from the adhesion of scale (hereinafter, also simply referred to as a "protection operation") is performed. The protection operation does not require use of a cleaning agent and does not require a long time, unlike the cleaning operation in Patent Literature 1. Therefore, the protection operation according to the embodiment can be performed while allowing intervention of the hot water supply operation.

Figure 3:
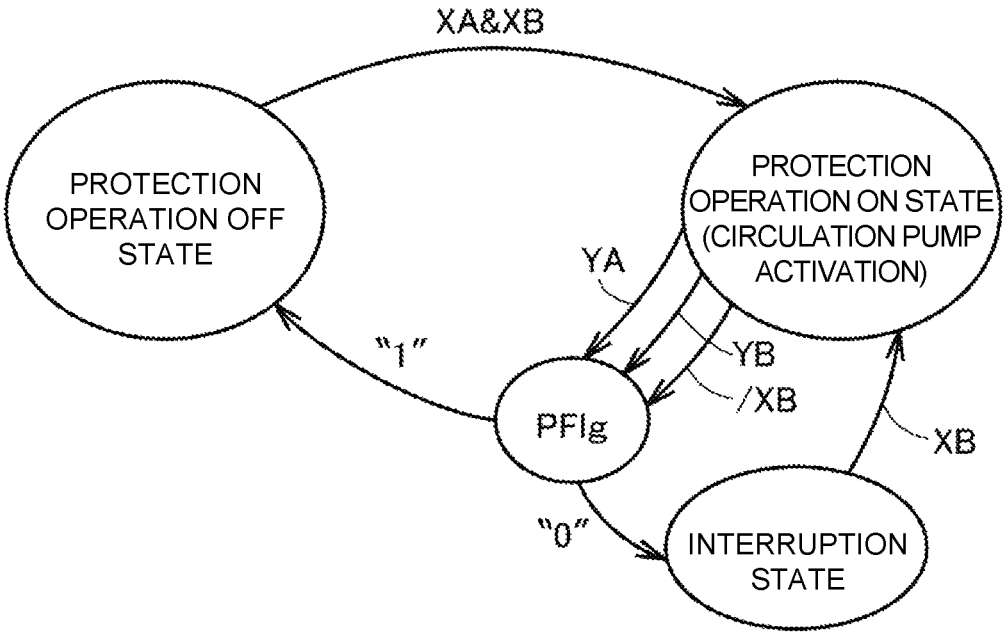
FIG. 3 is a state transition diagram of a protection operation of a circulation pump by the hot water supply device according to Embodiment 1.

FIG. 3 is a state transition diagram of the protection operation of the circulation pump by the hot water supply device according to Embodiment 1.

Referring to FIG. 3, in a state in which the protection operation of circulation pump 80 is not performed (hereinafter referred to as a "protection operation OFF state"), the circulation pump 80 is stopped. In the protection operation OFF state, when both a condition XA regarding a stop history of the circulation pump 80 and a condition XB regarding the stop of the operation of the hot water supply device 100 are satisfied, the protection operation of operating the circulation pump 80 is performed. Accordingly, a transition from the protection operation OFF state to a protection operation ON state occurs.

FIG. 4 is a chart showing a list of content of each of the conditions shown in FIG. 3.

Referring to FIG. 4, the condition XA is satisfied when the circulation pump 80 has been stopped for at least T1 (for example, T1=24 (hours)) since the last stop. Whether or not the condition XA is satisfied can be determined by measuring an elapsed time from the stop of the circulation pump 80 with the clocking part 15*a*. The condition XA corresponds to one example of a "first condition," and T1 corresponds to one example of a "first time."

The condition XB is satisfied when the hot water supply operation is stopped (the hot water supply operation is turned off) and is not satisfied when the hot water supply operation is being performed (the hot water supply operation is turned on) (that is, a condition /XB is satisfied). An ON period of the hot water supply operation may be defined to include not only a period during which the heating by the heat source unit 30 is performed, but also a period after the heating is stopped (for example, a purge period of an exhaust gas).

Alternatively, the condition XB may be satisfied when the hot water supply operation is stopped and the instant hot water operation is out of the reservation period. In this case, the condition XB is not satisfied when the hot water supply operation is being performed or during the reservation period for the instant hot water operation (the condition /XB is satisfied). The condition XB corresponds to an example of a "second condition."

Referring again to FIG. 3, in the protection operation ON state, the circulation pump 80 is operated, and thus the instant hot water circulation path is formed. Accordingly, it is possible to prevent scale from adhering around the bearing of the circulation pump 80.

Figure 5:
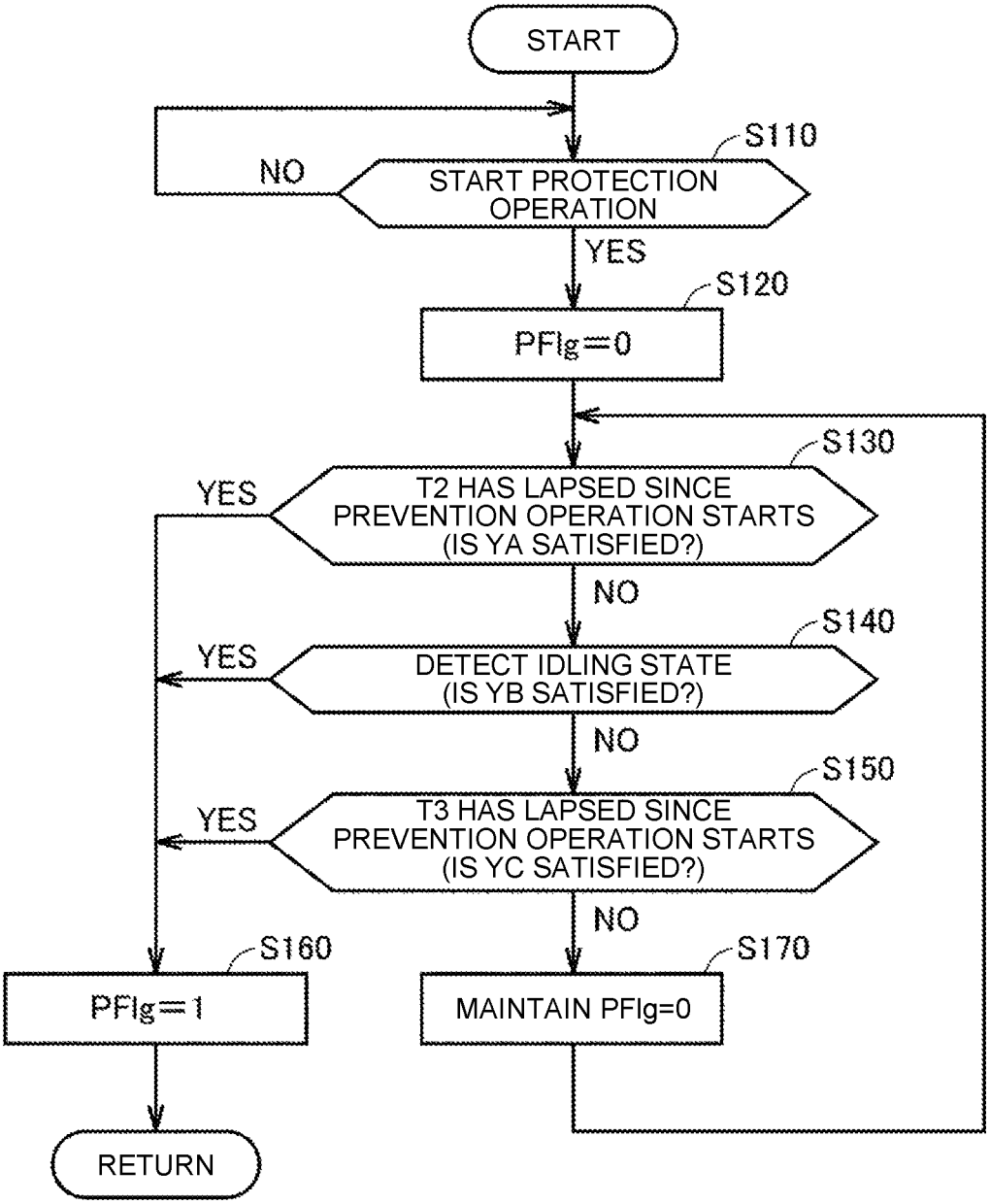
FIG. 5 is a flowchart showing a control process related to management of a protection operation completion flag shown in FIG. 3.

In the protection operation ON state, a protection operation completion flag PFlg is operated according to a flowchart shown in FIG. 5.

Referring to FIG. 5, the controller 10 determines whether or not the protection operation of the circulation pump 80 is started in Step (hereinafter, simply referred to as "S") 110. YES is determined in S110 when a transition from another state to the protection operation ON state occurs in FIG. 3, and otherwise NO is determined.

The controller 10 clears the protection operation completion flag PFlg is cleared to 0 in S120 at the start of the protection operation in which the circulation pump 80 is operated (YES in S110). At this point, it is possible to clear the value measured by the clocking part 15*a*.

In the protection operation ON state (FIG. 3), the protection operation completion flag PFlg=0 is set to "0" or "1" according to whether or not conditions of S130 to S150 are satisfied. In S130, the controller 10 determines whether T2 (for example, T2=1 to 3 (minutes)) has elapsed from the start of the protection operation (a condition YA) according to the value measured by the clocking part 15*a*. When the condition YA is satisfied, the circulation pump 80 has been operated continuously for T2. T2 corresponds to an example of a "second time." The condition YA corresponds to a basic termination condition of the protection operation.

Further, in S140, the controller 10 detects whether the circulation pump 80 is being operated in a state in which no fluid is present (a so-called idling state) by determining whether or not a condition YB is satisfied. For example, the condition YB is satisfied when a state in which a flow rate (the flow rate detector 82) of the instant hot water circulation path is equal to or less than a determination flow rate Qx is continuously detected for a determination time Tx.

In S150, the controller 10 determines whether or not T3 (T3<T2) has elapsed from the start of the protection operation (a condition YC) according to the value measured by the clocking part 15*a*. Furthermore, the conditions YA to YC in S130 to S150 are described in FIG. 4 together with the above conditions XA and XB (/XB). T3 corresponds to an example of a "third time."

The controller 10 sets the protection operation completion flag PFlg=1 in S160 when YES is determined in at least one of S130 to S150 in the protection operation ON state, that is, when at least one of the conditions YA to YC is satisfied. On the other hand, when NO is determined in all of S130 to S150, that is, when none of the conditions YA to YC are satisfied, the protection operation completion flag PFlg=0 is maintained in S170.

Therefore, although the circulation pump 80 is not continuously operated over T2 in S130 (that is, the condition YA is not satisfied), the condition YC is satisfied when the operation is continuously performed for T3 shorter than T2. When the protection operation completion flag PFlg=1, the processing of the flowchart in FIG. 5 is restarted, and the protection operation completion flag PFlg=1 is maintained until the next protection operation is started (until YES is determined in S110).

Referring to FIG. 3 again, when condition YA, YB or /XB is satisfied in the protection operation ON state, the circulation pump 80 is stopped. Further, the transition to the protection operation OFF state or an interruption state occurs according to the protection operation completion flag PFlg at this point. In particular, when the hot water supply operation is started during the protection operation (when the condition XB is not satisfied), the circulation pump 80 is stopped, and an intervention process which gives priority to the hot water supply operation can be performed. In addition, as described with reference to FIG. 4, when the condition XB includes that it is out of the reservation period of the instant hot water operation, the intervention process which gives priority to the instant hot water operation can be further performed.

When the condition YA is satisfied in the protection operation ON state, YES is determined in S130 in FIG. 5, and PFlg=1 is set (S160), and thus the transition from the protection operation ON state to the protection operation OFF state occurs. In this case, the continuous operation time T2 of the circulation pump 80 is ensured, and the protection operation is ended normally.

When the condition /XB is satisfied in the protection operation ON state (that is, when the condition XB is not satisfied), a value of the protection operation completion flag PFlg differs according to whether or not the condition YC in S150 is satisfied. That is, when the continuous operation time of the circulation pump 80 is T3 or more (T3<T2), PFlg=1, and when it does not reach T3, PFlg=0.

When the protection operation completion flag PFlg=0, that is, when the condition XB is not satisfied before the continuous operation time of the circulation pump 80 reaches T3, a transition from the protection operation ON state to the interruption state occurs. In the interruption state, the resumption of the protection operation is awaited, and when the condition XB is satisfied again according to the stop of the hot water supply operation (or the termination of the instant hot water reservation period), the transition to the protection operation ON state occurs. Accordingly, the circulation pump 80 is started, the protection operation is automatically started, and YES is determined in S110 in FIG. 5.

On the other hand, when the condition XB is not satisfied after the continuous operation time of the circulation pump 80 is ensured for T3 or more, the protection operation completion flag PFlg=1, and thus the transition from the protection operation ON state to the protection operation OFF state occurs. In this case, the next protection operation is not performed until the elapsed time from the stop of the circulation pump 80 reaches T1 (the condition XA).

Also when the condition YB is satisfied in the protection operation ON state, that is, when the idling of the circulation pump 80 is detected due to the protection operation, YES is determined in S140 in FIG. 5, and PFlg=1 is set (S160), and thus the transition from the protection operation ON state to the protection operation OFF state occurs. Also in this case, the next protection operation is not performed until the time elapsed from the stop of the circulation pump 80 reaches T1 (the condition XA). Thus, it is possible to prevent the protection operation from being repeatedly restarted in a short period of time even when the idling state is detected.

Figure 6:
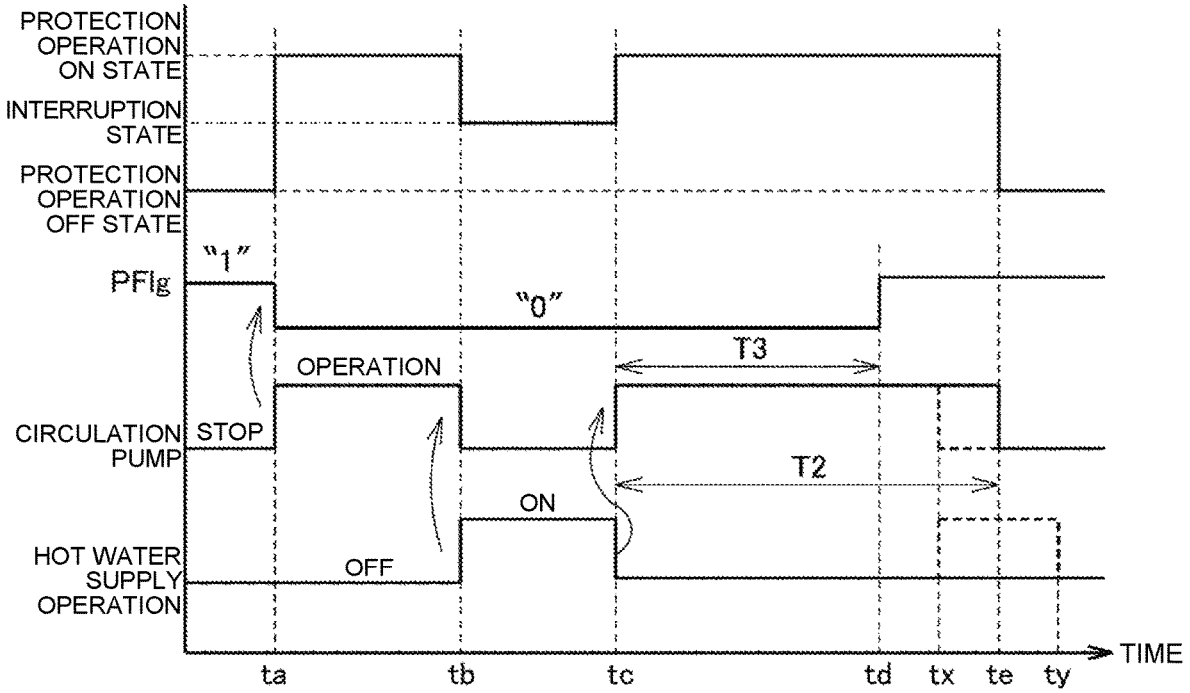
FIG. 6 is a waveform diagram showing an operation example of a protection operation of the circulation pump by the hot water supply device according to Embodiment 1.

FIG. 6 is a waveform diagram showing an operation example of the protection operation of the circulation pump by the hot water supply device according to Embodiment 1.

Referring to FIG. 6, at time ta, when the elapsed time from the previous stop of the circulation pump 80 reaches T1 (that is, the condition XA is satisfied), the hot water supply operation is being stopped (that is, the condition XB is satisfied), and thus the transition from the protection operation OFF state to the protection operation ON state occurs. Accordingly, the circulation pump 80 operates to start the protection operation. With the start of the protection operation, the protection operation completion flag PFlg is cleared to 0 (S120).

When the hot water supply operation is started at time tb before T2 and T3 elapse from the time ta, the condition XB is not satisfied (the condition /XB is satisfied), and thus the circulation pump 80 is stopped. At the time tb, since the protection operation completion flag PFlg=0, the transition from the protection operation ON state to the interruption state in FIG. 3 occurs.

At time tc, when the hot water supply operation is stopped, the transition from the interruption state to the protection operation ON state in FIG. 3 occurs, the circulation pump 80 is operated again, and the protection operation is restarted. Thereafter, at time te when T2 has elapsed from the time tc, the condition YA is satisfied, the circulation pump 80 is stopped, and the protection operation is ended. At this time, the transition from the protection operation ON state to the protection operation OFF state occurs.

On the other hand, the protection operation completion flag PFlg is changed from 0 to 1 by the determination in S150 in FIG. 5 being YES at time td when T3 has elapsed from the time tc, that is, at a timing earlier than time te.

Here, as shown by a dotted line in FIG. 6, it is assumed that the hot water supply operation is performed at time tx between times td and te, and the hot water supply operation is stopped at time ty after time tx. In this case, at time tx, the circulation pump 80 is stopped for the intervention process of the hot water supply operation. However, since the protection operation completion flag PFlg has already been changed to 1, the transition from the protection operation ON state to the protection operation OFF state in FIG. 3 occurs at this point. Therefore, even when the hot water supply operation is stopped at the time ty, the protection operation by the operation of the circulation pump 80 is not restarted as at the time tc.

As described above, according to the hot water supply device according to Embodiment 1, whenever a continuous stop time of the circulation pump 80 reaches a predetermined value (T1), priority is given to the hot water supply operation (and the instant hot water operation), and then the protection operation can be performed at an appropriate timing. As a result, in the hot water supply device having the instant hot water function, the protection operation of the circulation pump 80 for preventing the adhesion of the scale can be efficiently and appropriately performed.

Also, during the protection operation, the hot water supply operation (and the instant hot water operation) can be prioritized by the intervention process. After the hot water supply operation (and the instant hot water operation) is ended, the protection operation can be automatically performed again. On the other hand, when the continuous operation time of the circulation pump 80 is secured for T3 (T3<T2) at the time of occurrence of the intervention, or when the idling of the circulation pump 80 is detected, the protection operation is ended as it is, and thus it is possible to prevent the protection operation from being excessively repeated.

Embodiment 2

In Embodiment 1, a start trigger of the protection operation is generated on the basis of the elapsed time since the circulation pump 80 was stopped. However, the measurement of the elapsed time is based on a continuous power-on state in which the connection of the plug 93 is maintained, as described with reference to FIG. 2.

Meanwhile, a usage mode in which the plug 93 is disconnected from the system power supply 150 whenever the use of the hot water supply device 100 is ended, and the electric power is turned on whenever the use of the hot water supply device 100 is started, is also assumed according to the user. On the other hand, under such a usage mode, in the hot water supply device according to Embodiment 1, it is difficult to measure the elapsed time, and thus it is difficult to appropriately perform the protection operation of the circulation pump 80.

Figure 7:
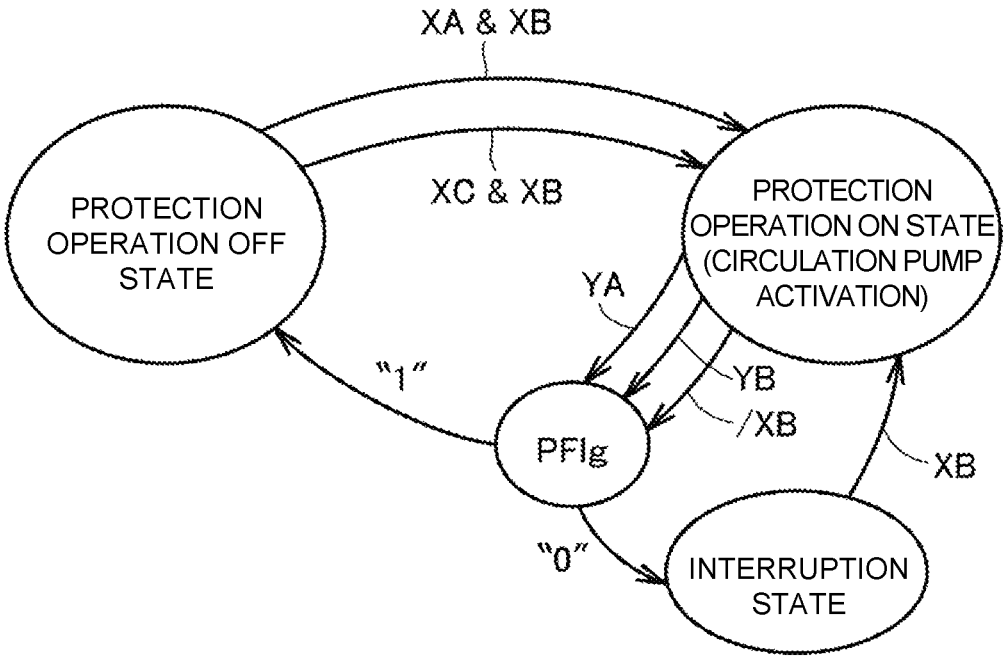
FIG. 7 is a state transition diagram of a protection operation of a circulation pump by a hot water supply device according to Embodiment 2.

FIG. 7 is a state transition diagram of the protection operation of the circulation pump by the hot water supply device according to Embodiment 2, and FIG. 8 is a chart showing a list of contents of each of conditions shown in FIG. 7.

Referring to FIGS. 7 and 8, in the hot water supply device according to Embodiment 2, in addition to the conditions XA and XB (/XB) and the conditions YA to YC similar to those in Embodiment 1, a condition XC relating to power supply is further set.

The condition XC is satisfied for a certain period (for example, about several tens of seconds) when T4 (for example, about 5 to 10 seconds) has elapsed since the power supply of the hot water supply device 100 was turned on. In a period (the power-on state) after the elapse of the certain period, the condition XC is not satisfied. Whether or not the condition XC is satisfied can also be determined on the basis of the value measured by the clocking part 15*a* of which the operation is started in response to the power supply. T4 corresponds to an example of a "fourth time".

In the hot water supply device according to Embodiment 2, the transition from the protection operation OFF state to the protection operation ON state occurs not only when the conditions XA and XB equivalent to those in Embodiment 1 are satisfied but also when the conditions XC and XB relating to a certain period after the power supply is turned on are satisfied. On the other hand, a condition relating to the transition from the protection operation ON state to another state is the same as in Embodiment 1.

As a result, according to the hot water supply device according to Embodiment 2, since the power supply is turned off whenever the use of the hot water supply device 100 is ended, even under a usage mode in which it is difficult to accurately measure the elapsed time since the circulation pump 80 is stopped with the clocking part 15*a*, it is possible to appropriately secure an opportunity for the protection operation of the circulation pump 80.

[Modified Example of Hot Water Supply Device]

Figure 9:
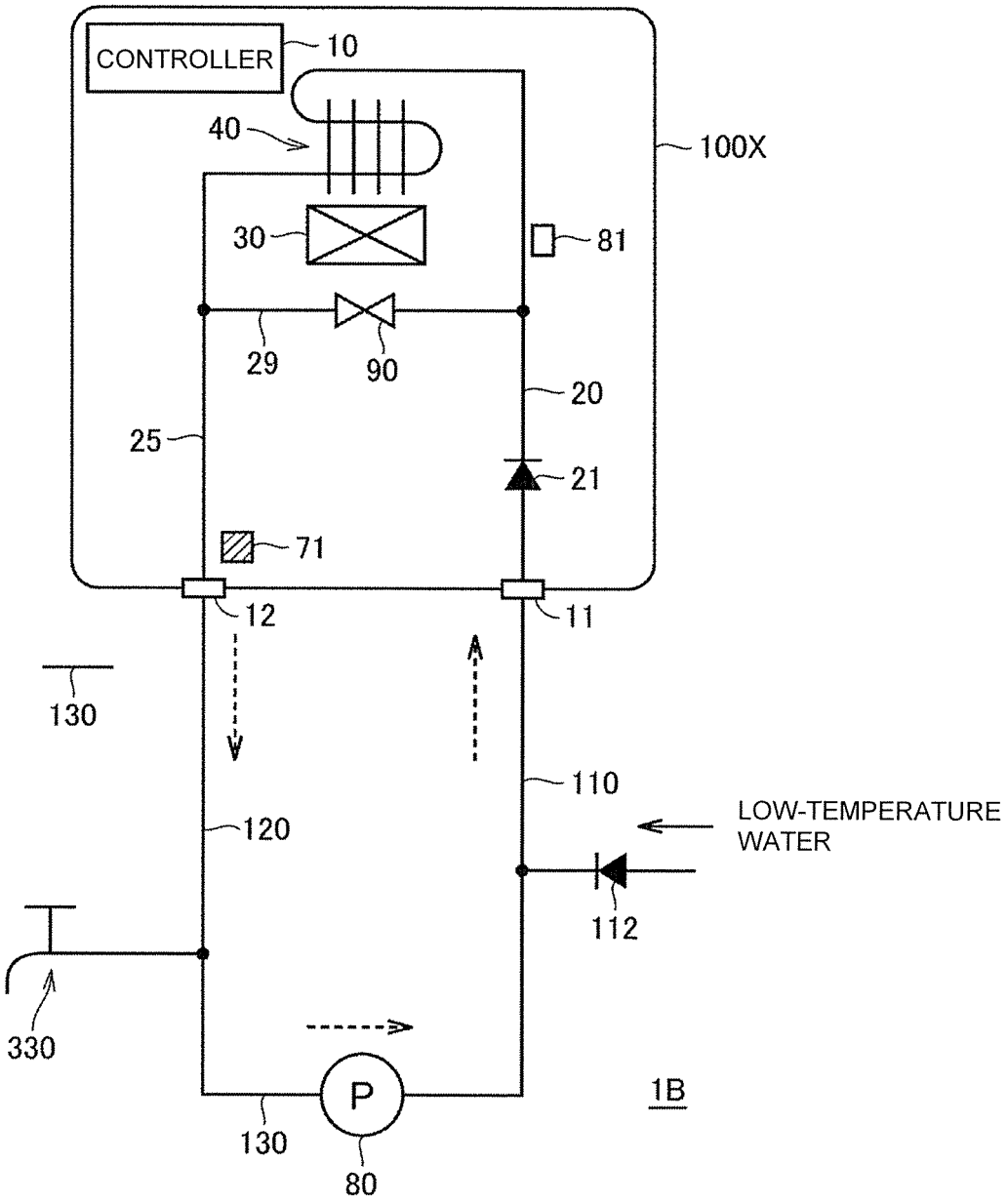
FIG. 9 is a block diagram showing a configuration of a hot water supply system including a hot water supply device according to a modified example of the embodiment.

FIG. 9 is a block diagram showing a configuration of a hot water supply system including a hot water supply device according to a modified example of the present embodiment.

Referring to FIG. 9, a hot water supply system 1B includes a hot water supply device 100X according to a modified example of the present embodiment, a low-temperature water pipe 110, and a high-temperature water pipe 120. The hot water supply device 100X has a water inlet port 11 and a hot water outlet port 12 without having a circulation port 13. Therefore, unlike the hot water supply device 100 of FIG. 1, the circulation path 28 is not provided inside the hot water supply device 100X.

Other configurations of the hot water supply device 100X are the same as those of the hot water supply device 100, and thus detailed description thereof will not be repeated. Also in the hot water supply device 100X, it is possible to omit the arrangement of the bypass path 29 and the flow rate control valve 90 and to configure so that the entire amount of the introduced low-temperature water flows through the heat exchanger 40.

In the hot water supply system 1B, low-temperature water is supplied to the low-temperature water pipe 110 via a check valve 112. The low-temperature water pipe 110 is connected to the water inlet port 11. The high-temperature water pipe 120 connects between the hot water outlet port 12 and a hot water tap 330. The circulation pipe 130 connects between the high-temperature water pipe 120 and the low-temperature water pipe 110.

The circulation pump 80 can be connected to the circulation pipe 130. During the hot water supply operation in which the circulation pump 80 is stopped, when the hot water tap 330 is opened, at least some of the low-temperature water introduced from the low-temperature water pipe 110 to the water inlet port 11 is heated by the heating mechanism (a heat source unit 30 and a heat exchanger 40). The high-temperature water obtained by the heating is output from the hot water tap 330 through the hot water outlet port 12 and the high-temperature water pipe 120. Accordingly, the hot water supply operation can be performed also in the hot water supply device 100X, similarly to the hot water supply device 100.

Meanwhile, when the circulation pump 80 is operated at the time of closing the tap, a fluid path (an internal path) including the water inlet port 11, the water inlet path 20, the heat exchanger 40 (the heating mechanism), the hot water outlet path 25, and the hot water outlet port 12 can be formed inside the hot water supply device 100. Further, a fluid path (an external path) which bypasses the hot water tap 330 via the hot water outlet port 12, the high-temperature water pipe 120, the circulation pipe 130 and the low-temperature water pipe 110 and reaches the water inlet port 11 can be formed outside the hot water supply device 100. As a result, the instant hot water circulation path can also be formed in the hot water supply system 1B.

Also in hot water supply system 1B, the similar protection operation can be performed by controlling the circulation pump 80 according to Embodiment 1 or 2. In this way, also in the hot water supply device 100X without the circulation port 13, the protection operation of the circulation pump 80 for preventing the adhesion of the scale can be efficiently and appropriately executed.

Further, in the hot water supply systems 1A and 1B, the circulation pump 80 is not limited to the examples shown in FIGS. 1 and 9 as long as it can form the same instant hot water circulation path as described above, and the circulation pump 80 may be located anywhere outside or inside the hot water supply devices 100 and 100X. That is, also in a configuration in which the circulation pump 80 is not built in the hot water supply devices 100 and 100X, the provision of the controller 10 for controlling the stop and the operation of the circulation pump 80 allows a test mode according to the embodiment to be realized.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A hot water supply device which supplies hot water to a hot water tap, comprising:

a heating mechanism;

an internal path which forms an instant hot water circulation path, through which a fluid passes through the heating mechanism, together with an external path which bypasses the hot water tap outside the hot water supply device when the hot water tap is closed and a circulation pump is operated; and a controller which instructs operation and stop of the heating mechanism and the circulation pump, wherein the controller performs a protection operation of operating the circulation pump for a second time when a first condition that the stop of the circulation pump has continued for a first time is satisfied and a second condition related to a stop of a hot water supply operation is further satisfied, wherein the controller stops the circulation pump and interrupts the protection operation when the second condition is not satisfied during the protection operation, and wherein the controller restarts the protection operation when the second condition is satisfied after interruption of the protection operation and an operation time of the circulation pump until the interruption is equal to or less than a third time shorter than the second time, and ends the protection operation when the operation time is longer than the third time.

2. The hot water supply device according to claim 1, wherein the controller detects idling of the circulation pump and ends the protection operation when a state in which a flow rate of the instant hot water circulation path is equal to or less than a predetermined determination flow rate continues for a predetermined determination time during the protection operation.

3. The hot water supply device according to claim 2, wherein the second condition is satisfied when the hot water supply operation is stopped, and is not satisfied during the hot water supply operation.

4. The hot water supply device according to claim 2, wherein the second condition is satisfied when the hot water supply operation is stopped and it is out of a reservation period of an instant hot water operation, and is not satisfied during the hot water supply operation or when it is within the reservation period of the instant hot water operation.

5. The hot water supply device according to claim 2, wherein the controller also performs the protection operation when a third condition that a fourth time have elapsed since electric power has been supplied to the hot water supply device is satisfied and the second condition is further satisfied.

6. The hot water supply device according to claim 1, wherein the second condition is satisfied when the hot water supply operation is stopped, and is not satisfied during the hot water supply operation.

7. The hot water supply device according to claim 1, wherein the second condition is satisfied when the hot water supply operation is stopped and it is out of a reservation period of an instant hot water operation, and is not satisfied during the hot water supply operation or when it is within the reservation period of the instant hot water operation.

8. The hot water supply device according to claim 1, wherein the controller also performs the protection operation when a third condition that a fourth time have elapsed since electric power has been supplied to the hot water supply device is satisfied and the second condition is further satisfied.

* * * * *